US009349355B2

(12) United States Patent
Jones

(10) Patent No.: US 9,349,355 B2
(45) Date of Patent: May 24, 2016

(54) DEVICE AND METHOD FOR TUNING AN ACOUSTIC PERCUSSION INSTRUMENT

(71) Applicant: Daniel R. Jones, Boise, ID (US)

(72) Inventor: Daniel R. Jones, Boise, ID (US)

( * ) Notice: Subject to any disclaimer, the term of this patent is extended or adjusted under 35 U.S.C. 154(b) by 298 days.

(21) Appl. No.: 13/747,260

(22) Filed: Jan. 22, 2013

(65) Prior Publication Data

US 2014/0202311 A1 Jul. 24, 2014

(51) Int. Cl.
*G10D 13/02* (2006.01)

(52) U.S. Cl.
CPC ..... *G10D 13/023* (2013.01); *Y10T 29/49574* (2015.01)

(58) Field of Classification Search
CPC ..... G10D 13/023
USPC ..... 84/413
See application file for complete search history.

(56) References Cited

U.S. PATENT DOCUMENTS

| | | | | |
|---|---|---|---|---|
| 1,165,666 | A * | 12/1915 | Gurney | 84/413 |
| 2,495,450 | A * | 1/1950 | Gladstone | G10D 13/021 84/411 R |
| 4,228,721 | A * | 10/1980 | Hancox | 84/411 R |
| 6,723,906 | B2 * | 4/2004 | Bourgoin | 84/411 R |
| 8,153,876 | B2 * | 4/2012 | Krishnamurthy | 84/413 |
| 8,642,867 | B1 * | 2/2014 | Bedson | 84/413 |

* cited by examiner

*Primary Examiner* — Jianchun Qin
(74) *Attorney, Agent, or Firm* — Parsons Behle & Latimer

(57) ABSTRACT

A system and method for reliably tuning an acoustic percussion instrument with a single adjustment. The system includes a cord attached to a tensioning device, the cord being arranged in connection with a plurality of brackets and tensioning elements. By increasing the tension on the cord, the tensioning elements are pulled in a downward direction with respect to the drum head, thereby increasing the tension thereon. The tuning system disclosed herein provides a substantially equal distribution of tensioning force through the arrangement of the cord and other elements of the system.

19 Claims, 8 Drawing Sheets

DEVICE AND METHOD FOR TUNING AN ACOUSTIC PERCUSSION INSTRUMENT

FIELD

The present disclosure relates to a device and method for tuning percussion instruments. More particularly, the present disclosure provides a device and method for tuning an acoustic percussion instrument using one or more tensioning devices arranged on the shell of the instrument.

BACKGROUND

In a conventional acoustic percussion instrument, or drum, a drum head is placed over one or more open ends of a shell or body of the instrument. A hoop is located at the periphery of the drum head and attaches to the drum shell, thereby securing the drum head. The drum head and the shell form a resonant cavity which produces the desired percussive sound. The characteristics of the drum head and the shell, including the materials, thicknesses and geometry, determine the characteristics of the sound produced by the drum.

The pitch of the sound produced by the drum may be altered by adjusting the amount of tension placed on the drum head. Referring to FIG. 1, which portrays a conventional acoustic percussion instrument including a device for tuning the pitch thereof, the process of tuning the drum 1 to a desired pitch is often accomplished by using a key 20 to adjust each of a number of tensioning lugs 25 that attach the hoop 15 to the shell by virtue of a plurality of casings 30. The tightening of the tensioning lugs 25 places tension on the drum head 10, thereby changing the pitch. This commonly used method requires that each of the tensioning lugs 25 be adjusted individually and that the pitch of the drum head be checked at each individual location. This process is most effectively accomplished by turning each of the tensioning lugs in an alternating pattern; i.e., turning lugs on opposing sides.

This tuning process is frequently repeated to compensate for wear and tear on the drum head, as well as changes in humidity and temperature. The tuning process can become even more cumbersome where the tuning takes place in an environment where there is significant ambient noise. Thus, tuning a drum head is a time-consuming and arduous task that requires skill and patience. Accordingly, there remains a significant need for an improved device and method for tuning an acoustic percussion instrument.

SUMMARY

The present disclosure provides a device, system and method for tuning an acoustic percussion instrument that presents significant advantages over the prior art. In particular, the tuning system of the present disclosure reduces the amount of time and skill required to accomplish this task by using a single-point adjustment to place tension simultaneously about the circumference of the drum head. The device, system and method of the present disclosure may be used in a variety of advantageous configurations, as will be apparent to one with skill in the art.

One aspect of the present disclosure provides a tuning device for an acoustic percussion instrument comprised of a tensioning device and a plurality of brackets and tensioning elements. The tensioning device is attached to a cord, which may be a cable or other resilient and flexible element, the cord being arranged in connection with each of the brackets. Each of the brackets comprise at least one bracket pivot and the tensioning elements comprise at least one tensioning pivot, each of the bracket pivots and tensioning pivots being configured to contact the cord in operation. Each of the plurality of brackets may be attached to the shell of an acoustic percussion instrument, either individually or by virtue of attaching to a frame that attaches to the shell. The tensioning elements may be configured to have fasteners that attach to connection points along a hoop.

Another aspect of the present disclosure provides a tuning system for an acoustic percussion instrument, comprising a drum with a shell having at least one open end covered by a drum head. A hoop attaches to the periphery of the drum head and attaches to the shell. The system further comprises a plurality of brackets having at least one bracket pivot and a plurality of tensioning elements comprising at least one tensioning pivot. The system further comprises a cord that engages the bracket pivots and tensioning pivots and a tensioning device attached to the cord. The system may also comprise a friction device capable of engaging the tensioning elements.

Yet another aspect of the present disclosure provides a method for preparing an acoustic percussion instrument for use with the device and system described herein. The method of the present disclosure comprises attaching a plurality of brackets to the shell; arranging a plurality of tensioning elements between the brackets and the hoop; arranging a cord in contact with the brackets and tensioning elements; and arranging a tensioning device on the shell of the drum and attached to the cord.

Other systems, methods, features, and advantages of the present disclosure will be or become apparent to one with skill in the art upon examination of the following drawings and detailed description. The features, functions and advantages that have been discussed can be achieved independently in various embodiments of the present invention or may be combined in yet other embodiments further details of which can be seen with reference to the following description and drawings.

BRIEF DESCRIPTION OF THE DRAWINGS

Many aspects of the invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION

In the following description, reference is made to the accompanying drawings, which form a part hereof, and in which is shown, by way of illustration, various embodiments of the present disclosure. It is understood that other embodiments may be utilized and changes may be made without departing from the scope of the present invention.

Figure 1:
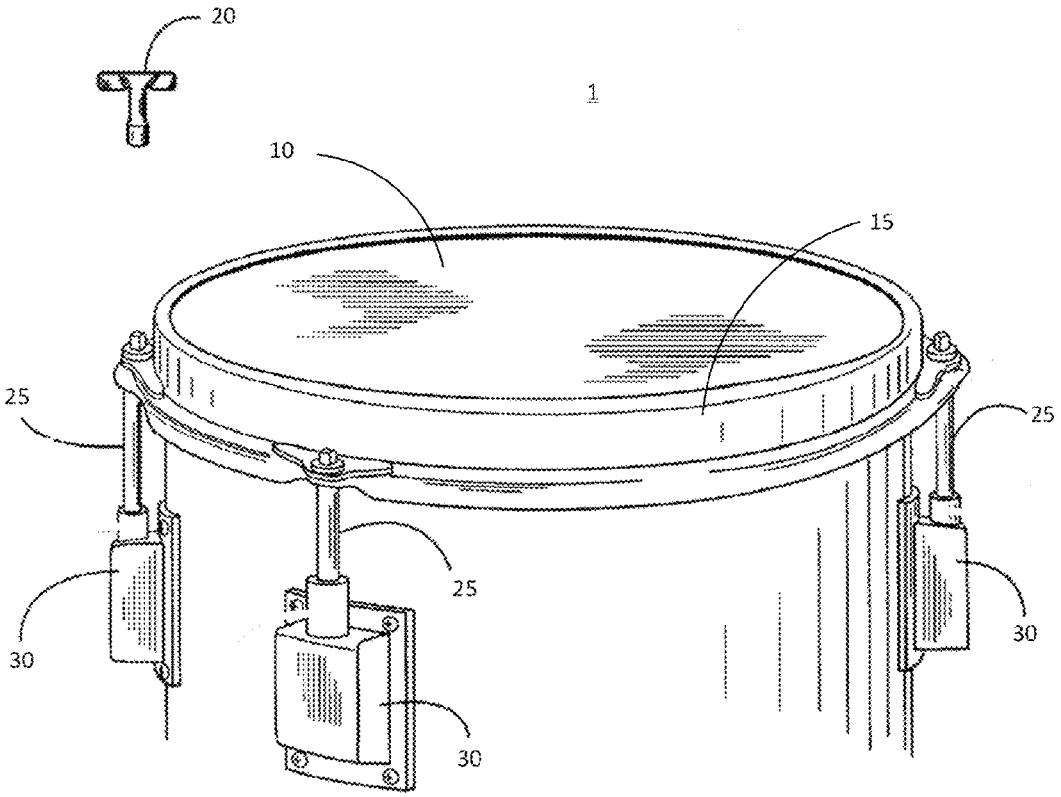
FIG. 1 PRIOR ART
FIG. 1 is an illustration of a tuning system for an acoustic percussion instrument, in accordance with the prior art.
Figure 2:
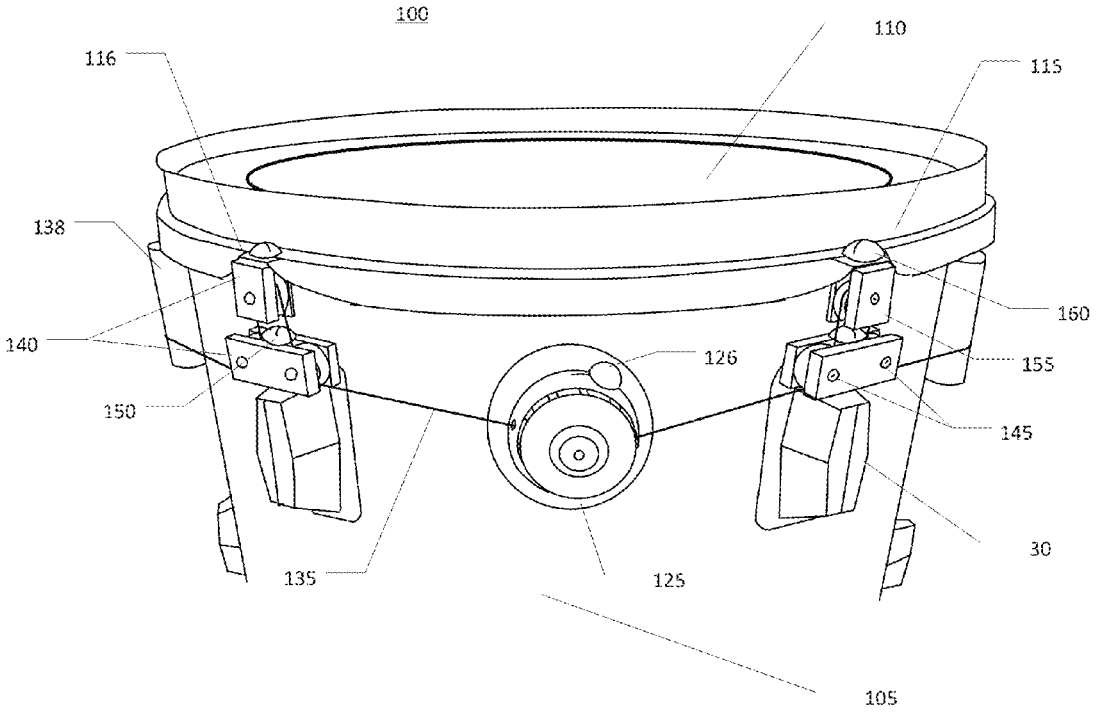
FIG. 2 is an illustration of a tuning system for an acoustic percussion instrument in accordance with one embodiment of the present disclosure.

FIG. 2 is an illustration of an exemplary device and system for tuning an acoustic percussion instrument 100, the acoustic percussion instrument comprising a shell 105, a drum head 110, and a hoop 115. This example of a tuning device further comprises a tensioning device 120, which is attached to the shell 105. The tensioning device 120 is connected to a cord 135 that is arranged around the shell 105. A plurality of brackets 140 are arranged on the shell 105, each bracket comprising at least one bracket pivot 145 and at least one tensioning pivot 155. The cord 135 is arranged in contact with each of the at least one bracket pivots 145 and at least one tensioning pivots 155 of each of said brackets 140. One or more guides 138 may be provided to prevent the cord 135 from contacting the shell 105. The illustrated example further comprises a plurality of fasteners 160 connecting the at least one tensioning pivot 155 to the hoop 115 at one of the hoop connection points 116. The at least one bracket pivot 145 is further connected to the shell 105, for example, by connecting the bracket pivots 145 to a casing 30 using a bracket attachment 150.

Figure 3:
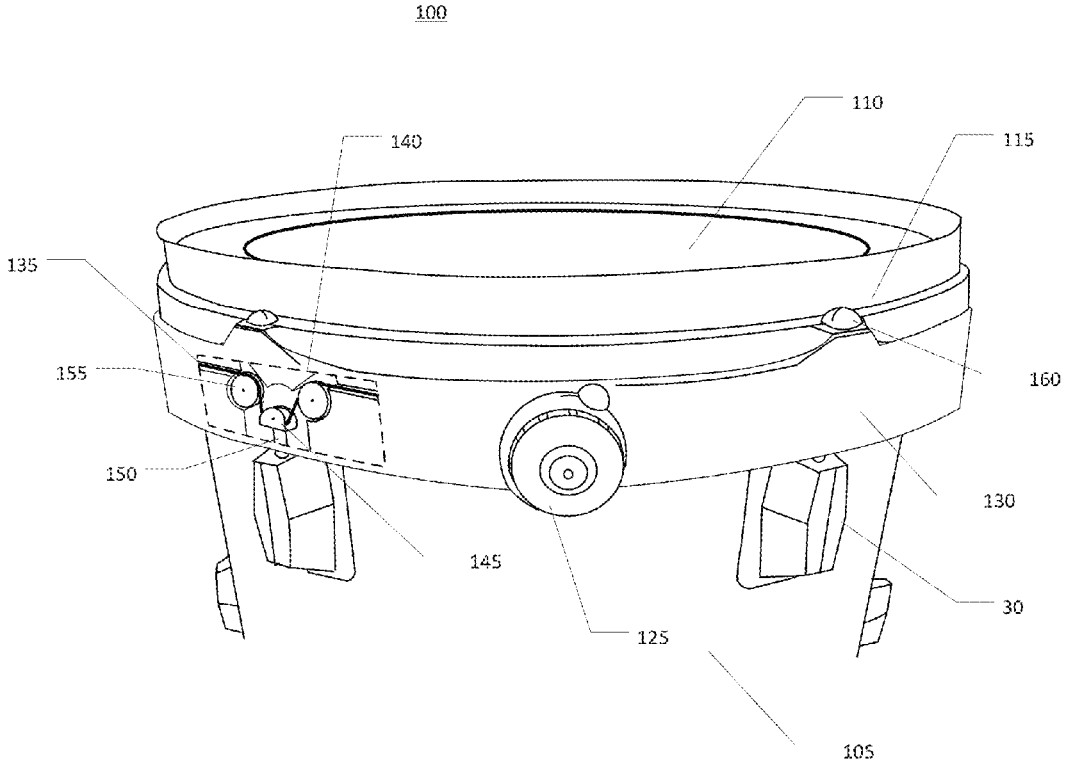
FIG. 3 is an illustration of a tuning system for an acoustic percussion instrument in accordance with another embodiment of the present disclosure.

FIG. 3 is an illustration of another example of a device and system for tuning an acoustic percussion instrument 100. In addition to many of the features visible in the example illustrated in FIG. 2, this example further comprises a frame 130 in which or on which the plurality of brackets 140 are mounted, each bracket 140 having at least one bracket pivot 145 and at least one tensioning pivot 155. The cord 135 is arranged in contact with each of the bracket pivots 145 and tensioning pivots 155.

The device and system enable the acoustic percussion instrument 100 to be tuned using the tensioning device 120. The tensioning device 120 may be any number of appropriate mechanisms, including a ratcheting device, which may, for example, employ a spool. One example of an appropriate tensioning device is provided in U.S. Pat. No. 7,992,261, incorporated herein by reference, which describes a ratcheting device for use in connection with articles of clothing. Other appropriate mechanisms include toggle clamps and "quick-release" devices. As shown in FIGS. 2-5, the tensioning device 120 may have a locking switch 125 that prevents the user from inadvertently changing the tension on the acoustic percussion instrument 100 during use. Locking switch 125 may be The tensioning device 120 is attached to a cord 135. For purposes of this disclosure, the cord may be provided as any device that is generally flexible and which transfers a force in tension from one point on the cord to another. In many examples, the cord will be formed of a rope or small cable that is durable and which resists deformation when under tension. The cord 135 is arranged having at least one end attached to the tensioning device 120, and in many examples will have both ends of the cord attached to the tensioning device. Alternatively, an end of the cord 135 not attached to the tensioning device may be attached to the acoustic percussion instrument 100 at an anchoring point.

The brackets 140 are comprised of at least one bracket pivot 145 and at least one tensioning pivot. The bracket pivots 145 are connected to the shell 105 of the percussion instrument 100. In the illustrated examples of FIGS. 2 and 3, the bracket pivots are connected to the shell 105 by virtue of the bracket attachment 150, which in turn connects to one of the casings 30 on the side of the shell 105. The bracket attachment may comprise a simple fastener attached to a lower bracket that houses two bracket pivots, as shown in FIG. 2. In other examples, the bracket attachment may comprise a lug attached to a lower bracket that holds one or more bracket pivots 145, as shown in FIG. 3. The bracket attachment may employ any device that will suitably and reliably connect the bracket 140 to the shell 105, including hooks, slotted fasteners, couplings, or the like.

The tensioning pivots 155 are connected to the hoop 115 by a plurality of fasteners 160, including at least one fastener for each bracket. The hoop 115 distributes the downward force to a periphery of the drum head 110, thereby tuning the acoustic percussion instrument 100. Similar to the bracket pivots, the fastener 160 may comprise a simple fastener, as shown in FIGS. 2 and 3, such as a threaded bolt. Alternatively, the fastener may be a lug or other element with some other attachment device at one or both ends. The attachment device may be any device that will suitably and reliably connect the bracket 140 to the hoop 115, including hooks, slotted fasteners, couplings, or the like.

The cord 135 is arranged in contact with both the bracket pivots 145 and the tensioning pivots 155 of each bracket. The bracket pivots 145 and tensioning pivots 155 are configured to allow relative vertical motion, wherein "vertical motion" is defined as being in a direction that is substantially perpendicular to the plane of the drum head 110. As the tension on the cord 135 is increased, the vertical distance between the bracket pivots 145 and the tensioning pivots 155 decreases, which pulls the hoop 115 downward onto the shell 105 with increasing force. As with conventional percussion instruments, this downward force on the hoop 115 is delivered to the drum head 110.

By arranging the brackets 140 in a symmetrical formation around the shell 105 (which may be on the inside or outside of the shell 105), the cord 135 delivers a substantially equal force to each bracket. If we assume that the hoop and shell are without substantial defect, the force will also deliver the tension to the drum head 110 in a substantially symmetrical fashion. Further, if we assume that the drum head has been manufactured properly to achieve homogeneity across the surface thereof, then the device and system of the present disclosure will tune the percussion instrument with superior accuracy simply by manipulation of the tensioning device 120.

Each of the bracketing pivots 145 and tensioning pivots 155 are configured to maintain contact with the cord 135, to withstand the tension on the cord 135, and to minimize any friction between the cord 135 and the pivots 145, 155. The pivots 145, 155 may be provided in the form of a sheave, as illustrated, but may also be provided as pins, hooks, slots, hoops, or the like. The surface of the pivot 145, 155 may be coated with a substance to reduce the friction force, which substances are known in the prior art or may be developed in the future.

Figure 4:
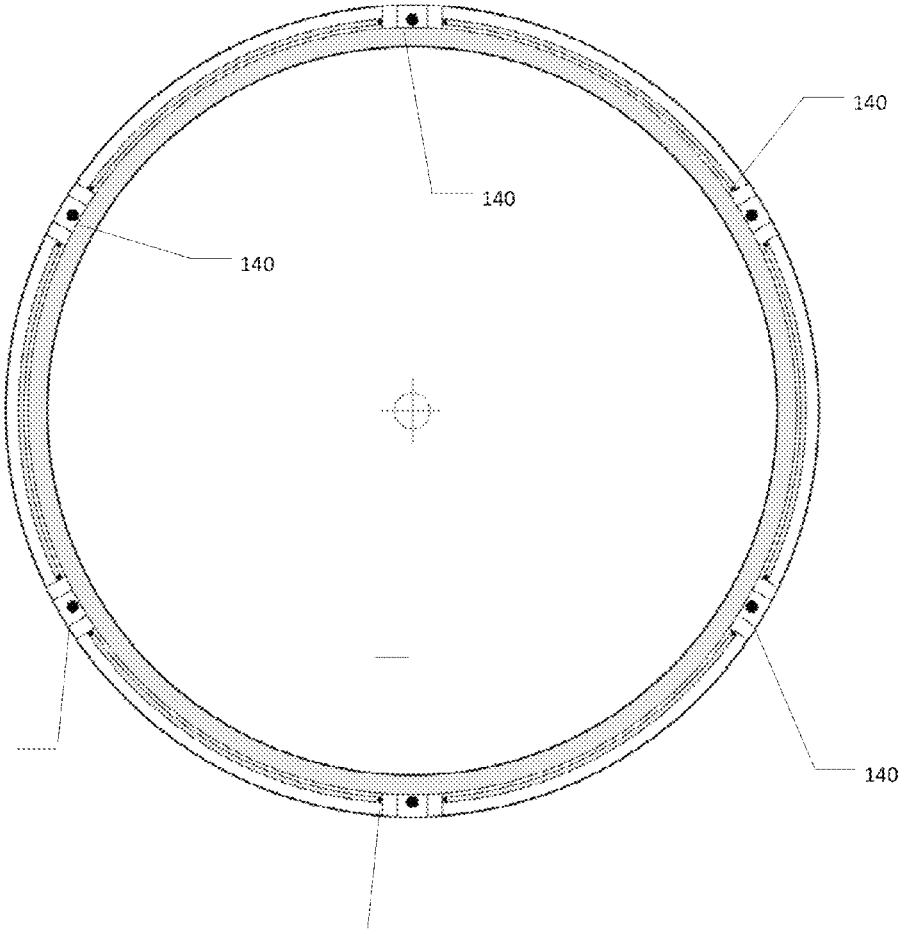
FIG. 4 is a top view of the frame of a tuning system in accordance with one embodiment of the present disclosure.
Figure 5:
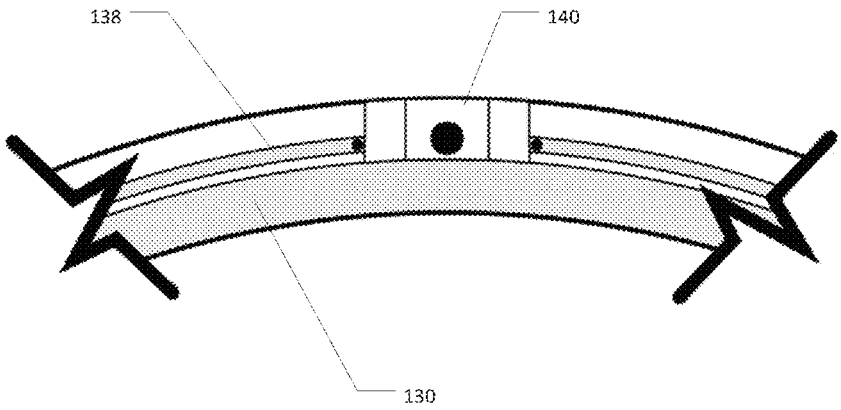
FIG. 5 is a partial view of the frame shown in FIG. 6A.
Figure 6A:
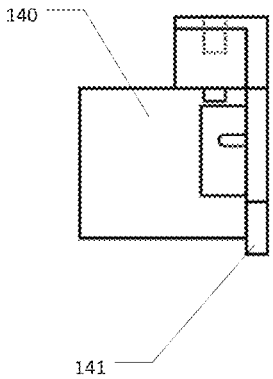
FIGS. 6A and 6B are illustrations of a bracket for use in a tuning system of the present disclosure, in accordance with the embodiment shown in FIG. 5.
Figure 6B:
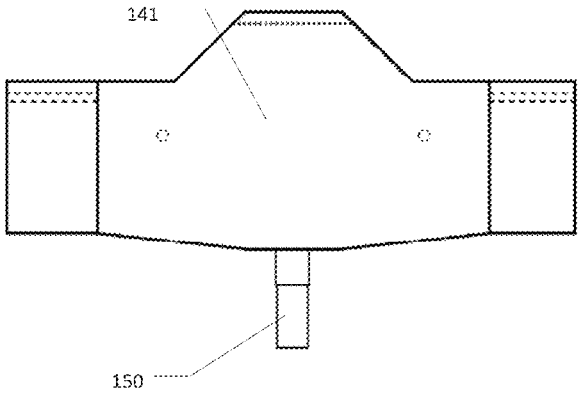
Figure 7A:
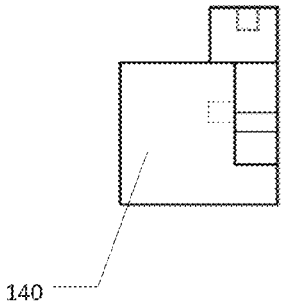
FIGS. 7A-7B, and FIGS. 8A-8B are further illustrations of elements of a bracket for use in a tuning system of the present disclosure, in accordance with the embodiment shown in FIG. 5.
Figure 7B:
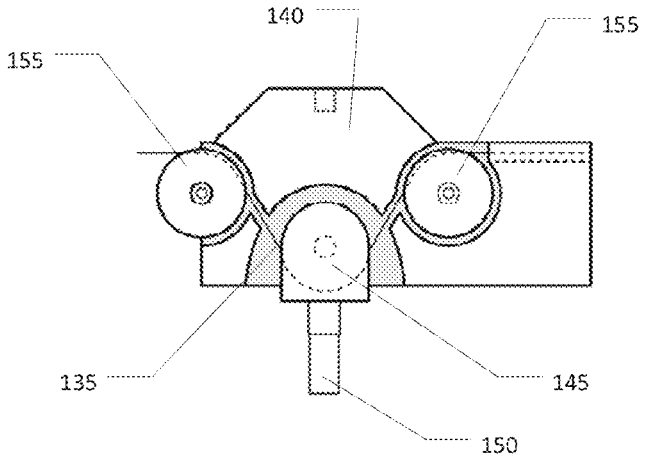
Figure 8A:
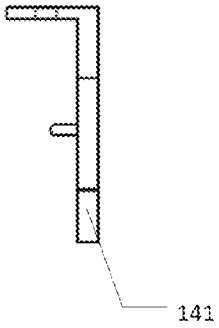
Figure 8B:
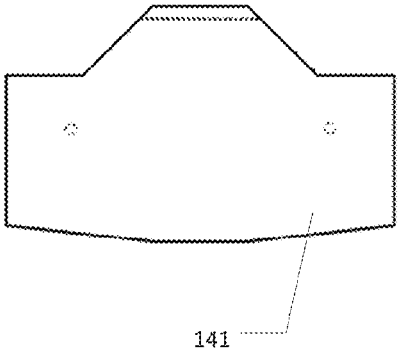

FIGS. 4 and 5 illustrate a frame 130 for use in another example of the present disclosure. In this example, the frame 130 is designed to fit on a percussion instrument with a shell 105 of a particular size and shape. The brackets 140 are arranged thereon with equal distances between each bracket. The brackets 140 may be formed integral to the frame 130, as a unitary piece, or may be attached thereto. The frame 130 may also include a slot 132 for housing the cord within the frame. In other examples, the brackets may be fixed directly to the shell 105 of the acoustic percussion instrument 100. The tensioning device 120 may also be attached to the frame 130 or attached directly to the shell 105.

FIGS. 6A-8B illustrate the individual brackets 140 with greater detail, in accordance with the example shown in FIGS. 4 and 5. In this example, each bracket 140 includes a bracket cover 141, which encloses the cord 135, bracket pivots 145, and tensioning pivots 155 therein, but allows access to these elements in case repair is required. The top the bracket 140 comprises an opening where the fastener 160 attaches to the tensioning pivots 155. The tensioning pivots 155 and the fastener may be connected by virtue of both elements attaching to the frame 130. The bracket pivot 145 is detached from the frame 130, allowing the relative vertical motion described above. As shown in FIG. 7B, the bracket attachment 150 comprises a housing for the bracket pivot 145 attached to a lug which is configured to attach to a casing 30.

Figure 9:
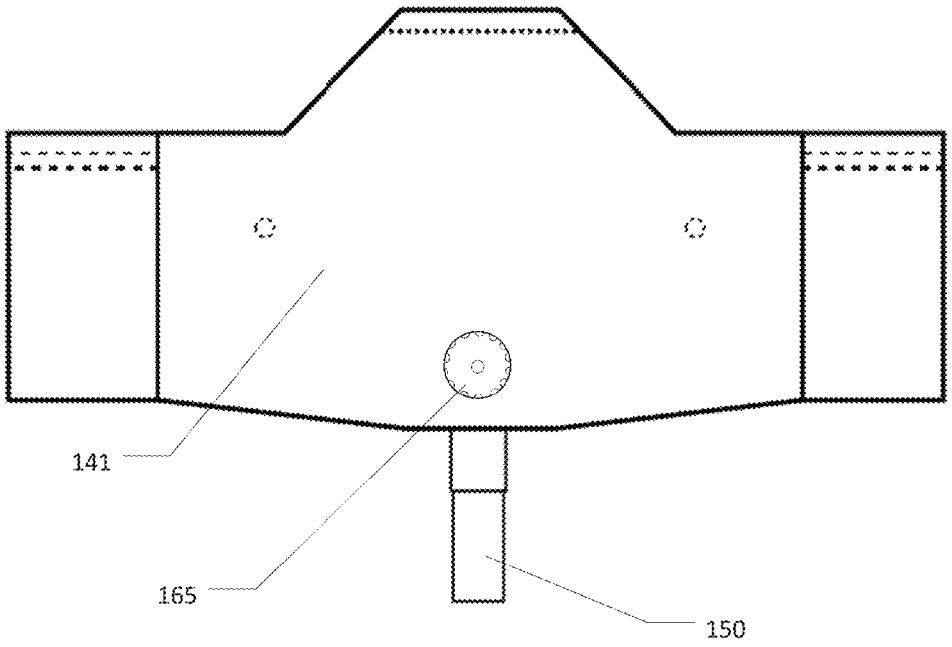
FIG. 9 is an illustration of a bracket for use in a tuning system in accordance with another embodiment of the present disclosure.

While the illustrated example comprises one bracket pivot 145 and two tensioning pivots 155, the present disclosure is intended to encompass numerous other configurations in which the bracket 140 may be arranged in any manner that creates a tensile force in a vertical direction. Further, while the present example provides that the tensioning pivots 155 and the fastener 160 may be connected by virtue of the frame 130, the device and system may also be configured such that the at least one bracket pivot 145 is connected to the frame 130 and the at least one tensioning pivot 155 is detached from the frame 130 but connected to the hoop 115 by fastener 160.

Where the brackets 140 are arranged in an equidistant fashion, the tension force delivered should be substantially equal at each corresponding pair surrounding the acoustic percussion instrument 100. In other configurations, or wherever deemed useful, the brackets may be provided with a friction device 165, such as a set screw, to adjust the delivery of force at each the bracket attachment 150 or the fastener 160, thereby manipulating the tuning process of the present disclosure. See, for example, FIG. 9.

As described above, the tuning device and system may be connected to an acoustic percussion instrument 100, such as a drum, by attachment to the shell 105. The present disclosure may be employed with or without the use of a frame 130. The frame itself may be shaped to conform to an outer surface of the shell 105 or may be some other geometric configuration that fits within or apart from the shell.

The system of the present disclosure may be used to tune a drum head 110 of an acoustic percussion instrument. Where a particular acoustic percussion instrument comprises more than one drum head 110, the device may be arranged with more than one cord 135 to enable simultaneous tuning of multiple drum heads. Alternatively, the system may include separate tensioning devices 120, cords 135, and frames 130 for each drum head 110.

In operation, the device and system of the present disclosure provide distinct advantages in tuning acoustic percussion instruments. The use of a cord with a tensioning device distributes the force in a substantially equal manner about the drum head. Thus, the present disclosure provides reliable and accurate single-point tuning of an acoustic percussion instrument.

Figure 10:
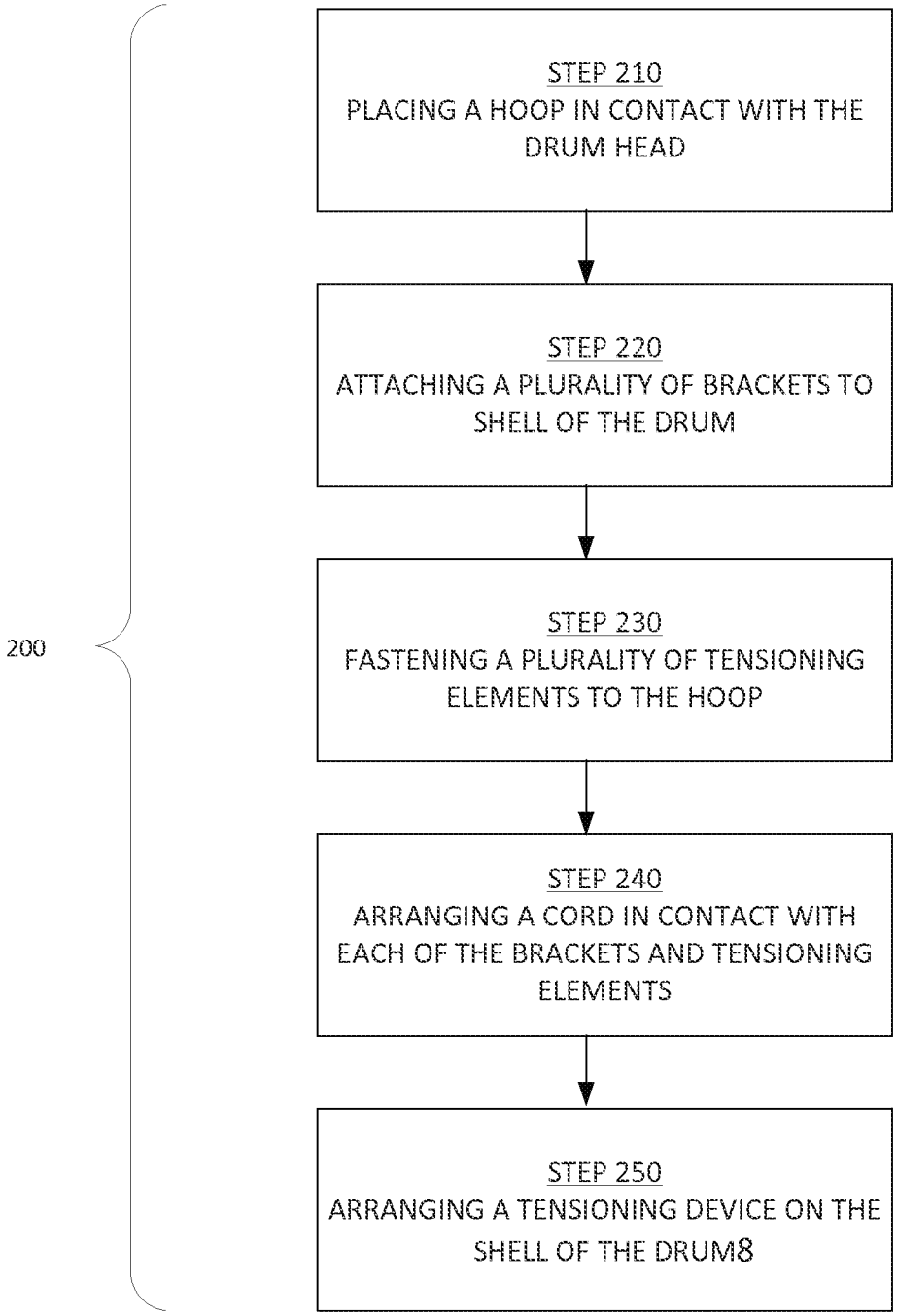
FIG. 10 is an exemplary flowchart of a method for preparing a tuning system for an acoustic percussion instrument in accordance with the present disclosure.

Another aspect of the present disclosure provides a method for preparing an acoustic percussion instrument for use with the device and system of the present disclosure. FIG. 10 illustrates an exemplary method 200 for preparing an acoustic percussion instrument. The method 200 comprises a step 210 of placing a hoop in contact with the drum head. The method 200 further comprises a step 220 of attaching a plurality of brackets to the shell of a drum. As described above, these brackets may be attached individually to the shell or may be attached as part of a frame. The method 200 further comprises a step 230 of attaching a plurality of tensioning elements to the hoop. This step may further comprises arranging the tensioning elements with regard to the brackets. The method 200 also comprises a step 240 of arranging a cord in contact with each of the brackets and tensioning elements. In some examples, the cord may be arranged with respect to the brackets prior to the step 210 of attaching the brackets to the shell. Finally, the method 200 comprises a step 250 of arranging a tensioning device on the shell of the drum. In some examples, this step is accomplished simultaneously to step 210, such as where the tensioning device is fixed to a frame. Accordingly, the ordering of the steps above may be altered in accordance with a particular embodiment.

It should be emphasized that the above-described embodiments of the present device and process are merely possible examples of implementations and merely set forth for a clear understanding of the principles of the disclosure. Many different embodiments of the disclosure described herein may be designed and/or fabricated without departing from the spirit and scope of the disclosure. All these and other such modifications and variations are intended to be included herein within the scope of this disclosure and protected by the following claims. Therefore the scope of the disclosure is not intended to be limited except as indicated in the appended claims.

What is claimed is:

1. A tuning device for an acoustic percussion instrument, comprising:

a tensioning device;

a plurality of brackets distinct from the tensioning device, each of the brackets comprising one or more bracket pivots;

a hoop that engages a periphery of a drum head at an open end of a shell;

a plurality of tensioning pivots, each of the tensioning pivots corresponding to one of the brackets, wherein the tensioning pivots are attached to the hoop; and a cord, having a first end and a second end, at least the first end of the cord being disposed in contact with the tensioning device, the cord being arranged in connection with each of the plurality of brackets, the cord being positioned entirely below the drum head, the tensioning device configured to control tension on the cord and thereby control tension on a drum head.

2. The tuning device of claim 1, wherein the cord is arranged such that it passes between at least one bracket pivot and at least one tensioning pivot within each corresponding pair.

3. The tuning device of claim 2, wherein each of the brackets and the tensioning device are arranged on the shell of the acoustic percussion instrument, and wherein the tensioning pivots are arranged such that each is connected to a drum head of the acoustic percussion instrument.

4. The tuning device of claim 3, wherein the one or more bracket pivots and the at least one tensioning pivot of each bracket are configured to allow movement in a vertical direction; and wherein the cord is configured to control the amount of vertical displacement between the bracket pivots and at least one tensioning pivot of each bracket.

5. The tuning device of claim 1, further comprising a plurality of tensioning elements, each of the tensioning elements comprising a first end and a second end, at least one tensioning pivot arranged at the first end, the second end comprising a fastener.

6. The tuning device of claim 5, wherein the fastener is adjustable.

7. The tuning device of claim 1, further comprising a frame, wherein each of the brackets are arranged on the frame.

8. The tuning device of claim 1, wherein the tensioning device comprises one of a group consisting of: a ratcheting spool device, a quick-release device, a toggle clamp, an adjustment screw, and a double-nutted bolt.

9. The tuning device of claim 1, wherein each of the brackets includes two bracket pivots.

10. The tuning device of claim 1, wherein each of the brackets corresponds to two tensioning pivots.

11. An acoustic percussion instrument comprising;

a shell having at least one open end;

a drum head arranged to cover the open end of the shell;

a hoop that engages a periphery of the drum head at the open end of the shell;

a plurality of brackets arranged along a periphery of the shell, each bracket comprising at least one bracket pivot;

a plurality of tensioning pivots, wherein the tensioning pivots are attached to the hoop;

a cord arranged such that it engages at least one bracket pivot and at least one tensioning pivot, the cord arranged entirely below the drum head; and a tensioning device attached to the cord, the tensioning device configured to control tension on the cord and thereby control tension on the drum head.

12. The instrument of claim 11, further comprising at least one set screw capable of engaging one of the tensioning pivots or one of the bracket pivots.

13. The instrument of claim 11, wherein the tensioning device comprises one of a group consisting of: a ratcheting spool device, a quick-release device, a toggle clamp, an adjustment screw, and a double-nutted bolt.

14. The instrument of claim 11, wherein the hoop forms a rim of the acoustic percussion instrument.

15. The instrument of claim 11, wherein the tensioning device is attached to an outer surface of the shell.

16. The instrument of claim 11, further comprising a frame attached to an outer surface of the shell, each of the plurality of brackets being arranged on the frame at equal distances apart, wherein the frame covers the cord.

17. The instrument of claim 16, wherein the frame is attached to the hoop.

18. The tuning device of claim 11, further comprising one or more guides attached to the shell to prevent the cord from contacting the shell.

19. A tuning device for an acoustic percussion instrument, comprising:

a tensioning device mounted to a shell of an acoustic percussion instrument;

a plurality of brackets, each of the brackets comprising one or more bracket pivots;

a hoop that engages a periphery of a drum head at an open end of the shell;

a plurality of tensioning pivots, each of the tensioning pivots corresponding to one of the brackets, wherein the tensioning pivots are attached to the hoop; and a cord, having a first end and a second end, at least the first end of the cord being disposed in contact with the tensioning device, the cord being arranged in connection with each of the plurality of brackets, the tensioning device configured to control tension on the cord and thereby control tension on the drum head.

* * * * *